US010480138B2

(12) United States Patent
Lambert

(10) Patent No.: US 10,480,138 B2
(45) Date of Patent: Nov. 19, 2019

(54) ILLUMINATED ROAD MARKER

(71) Applicant: David E. Lambert, Columbus, OH (US)

(72) Inventor: David E. Lambert, Columbus, OH (US)

( * ) Notice: Subject to any disclaimer, the term of this patent is extended or adjusted under 35 U.S.C. 154(b) by 0 days.

(21) Appl. No.: 16/000,658

(22) Filed: Jun. 5, 2018

(65) Prior Publication Data

US 2018/0347127 A1 Dec. 6, 2018

Related U.S. Application Data

(60) Provisional application No. 62/515,042, filed on Jun. 5, 2017.

(51) Int. Cl.

| | |
|---|---|
| ***E01F 9/00*** | (2016.01) |
| ***E01F 9/559*** | (2016.01) |
| ***F21S 8/00*** | (2006.01) |
| ***F21S 9/03*** | (2006.01) |
| *F21W 111/02* | (2006.01) |

(52) U.S. Cl.

CPC ..... *E01F 9/559* (2016.02); *F21S 8/032* (2013.01); *F21S 9/035* (2013.01); *F21W 2111/02* (2013.01)

(58) Field of Classification Search

CPC ..... E01F 9/559; F21S 8/032; F21S 9/035; F21W 2111/02

USPC ..... 404/12–14

See application file for complete search history.

(56) References Cited

U.S. PATENT DOCUMENTS

| | | | | |
|---|---|---|---|---|
| 4,136,990 A | | 1/1979 | Morgan | |
| 4,848,958 A | | 7/1989 | Sheldon | |
| 4,875,798 A | * | 10/1989 | May | E01F 9/553 404/12 |
| 5,327,850 A | | 7/1994 | Sly et al. | |
| 5,425,596 A | | 6/1995 | Steere et al. | |
| 5,782,552 A | | 7/1998 | Green et al. | |
| 5,825,544 A | | 10/1998 | Poisson | |
| 5,839,816 A | * | 11/1998 | Varga | E01F 9/559 362/153.1 |
| 5,984,570 A | | 11/1999 | Parashar | |
| 6,062,766 A | | 5/2000 | Fleury et al. | |
| 6,079,899 A | * | 6/2000 | Green | E01F 9/553 116/63 P |
| 6,726,398 B2 | | 4/2004 | Hamakawa et al. | |
| 7,018,131 B2 | * | 3/2006 | Jordan | E01F 9/559 404/12 |
| 7,859,431 B2 | | 12/2010 | Peddie et al. | |

(Continued)

FOREIGN PATENT DOCUMENTS

GB 692206 A 6/1953

OTHER PUBLICATIONS

Unauthored, Raised Pavement Markers, http://www.dot.state.oh.us/Divisions/ConstructionMgt/OnlineDocs/2009MOP/600%20Incidentals/621/621%20Raised%20Pavement%20Markers.htm, Feb. 27, 2019, 6 pgs.

(Continued)

*Primary Examiner* — Raymond W Addie

(74) *Attorney, Agent, or Firm* — Ice Miller LLP

(57) ABSTRACT

A road marker and an installation for a roadway extending along a longitudinal axis and having a roadway upper surface. The road marker includes a housing containing an energy source and a light source to be powered by the energy source and configured to emit light along the longitudinal axis.

15 Claims, 8 Drawing Sheets

(56) References Cited

U.S. PATENT DOCUMENTS

| | | | | |
|---|---|---|---|---|
| 8,840,335 | B2 * | 9/2014 | Martin | G08B 5/36 404/12 |
| 9,399,844 | B1 * | 7/2016 | King | G02B 6/0011 |
| 2004/0234335 | A1 | 11/2004 | Snagel et al. | |
| 2005/0008434 | A1 | 1/2005 | Chen | |
| 2006/0165961 | A1 | 7/2006 | Tsutsui | |
| 2009/0041541 | A1 | 2/2009 | Lowe | |
| 2010/0196095 | A1 | 8/2010 | Bjorklund | |
| 2014/0270941 | A1 * | 9/2014 | Intagliata | E01F 9/553 404/12 |
| 2014/0311056 | A1 | 10/2014 | Bobbitt | |

OTHER PUBLICATIONS

Unauthored, Maryland Department of Transportation, State Highway Administration, Baltimore, Maryland Invitation for Bids, Contract No. XX2285A76, F.A.P. No. N/A, Install and/or Replace RPM's, Jun. 18, 2018, 94 pgs.

Unauthored, MnDOT Pavement Marking Field Guide, Minnesota Department of Transportation, Office of Traffic, Safety, and Technology, Jun. 2015, 86 pgs.

Unauthored, Raised Pavement Markers (RPM), National Transportation Product Evaluation Program, American Association of State Highway and Transportation Officials, http://www.ntpep.org/Pages/RPM.aspx, Feb. 27, 2019, 2 pgs.

Unauthored, Dynatech Pavement Marking Blades & Equipment, www.dynatech.com/content/documents/product-catalogs/diamond.../PM-Catalog.pdf, 2013-2014, 21 pgs.

Unauthored, Special Note for Inlaid Pavement Markers, Jul. 2016, 4 pgs.

Unauthored, Special Note for Inlaid Pavement Markers, Dec. 5, 2018, 4 pgs.

Agent, Kenneth R. and Pigman, Jerry G., Winter Maintenance, Time for recessed?, Roads & Bridges, Feb. 2014, 4 pgs.

Nebraskaland-Kansasland-Coloradoland Tire Group, Common Tire Sizes, Goodyear, Mastercraft, Dunlop, Titan, Kelly and Alliance, http://www.thetirestore.com/common-tire-sizes.html, Feb. 27, 2019, 5 pgs.

Agent, Kenneth R. and Pigman, Jerry G., Winter Maintenance: Time for recessed?, Roads & Bridges, https://www.roadsbridges.com/winter-maintenance-time-recessed, Feb. 11, 2014, 11 pgs.

Gartner, Nathan H., et al. Improved Highway Lane Reflectorized Markers, Massachusetts Department of Transportation, Feb. 2016, 81 pgs.

International Searching Authority—United States Patent Office, International Search Report and Written Opinion of the International Searching Authority for PCT/US2018/43739. dated Dec. 21, 2018, 18 pgs.

International Searching Authority/US, Commissioner for Patents, International Search Report and Written Opinion for International Application No. PCT/US2018/036107, dated Sep. 4, 2018 (15 pages).

* cited by examiner

ILLUMINATED ROAD MARKER

RELATED APPLICATION

This application claims priority to U.S. Provisional Patent Application No. 62/515,042, which was titled "Illuminated Road Marker" and filed on Jun. 5, 2017. U.S. Provisional Patent Application No. 62/515,042 is incorporated by reference herein in its entirety.

BACKGROUND

Roadways may include reflective or illuminated markers to improve visibility of road or lane boundaries, crosswalks, or other features of a roadway to assist motorists, bicyclists, and/or pedestrians. However, conventional reflective markers often rely upon a vehicle's headlights in order to be visible, thereby reducing their utility and effectiveness, especially in adverse weather conditions or when debris or precipitation inhibits visibility of the markers. Conventional illuminated markers mounted to a roadway surface are vulnerable to damage and removal by vehicles and large equipment, such as snowplows clearing the roadway. Further, known illuminated markers have poor visibility due to their obstructed sight line with motorists, unreliable electronic power supply, and/or fragile or weak housing to cause failure or malfunction.

Therefore, there exists a need in the art for a roadway marker and installation that provides improved visibility of roadway boundaries and features, especially during rain, fog, snow, and nighttime conditions, to improve motorist and pedestrian safety and increase roadway travel efficiency and reliability. There also exists a need for a roadway marker and installation with enhanced durability to withstand destructive roadway conditions. Further, there exists a need in the art for a roadway marker and installation that is sufficiently self-contained to improve maintenance and reliability of the marker.

SUMMARY

In an embodiment of the present disclosure, a road marker for positioning at least partially below a surface of a roadway is provided. The road marker includes a housing having a first end portion having a first end portion height, a second end portion having a second end portion height, and a central portion disposed between the first end portion and the second end portion and having a central portion height greater than at least one of the first end portion height and the second end portion height. The road marker further includes a light source disposed at the first end portion and a solar energy collection member disposed at the central portion and configured to be positioned below the roadway surface.

In accordance with an embodiment of the present disclosure, a road marker includes a housing having a first end portion, a first end surface, a second end portion, a second end surface, and a lower surface extending from the first end surface to the second end surface, a light source disposed at the first end portion, and a plurality of recesses disposed in at least one of the first end surface, the second end surface, and the lower surface and configured to secure the housing in a road recess.

In accordance with an embodiment of the present disclosure, an installation for a roadway extending along a longitudinal axis and having a roadway upper surface is provided. The installation includes a channel formed in the roadway and extending in the longitudinal direction, the channel including a marker portion and a channel end tapered from the marker portion to the roadway upper surface, and a road marker disposed at least partially in the marker portion of the channel, the road marker comprising a housing containing an energy source and a light source, the light source powered by the energy source and configured to emit light along the longitudinal axis.

BRIEF DESCRIPTION OF THE FIGURES

The embodiments described herein and other features, advantages, and disclosures contained herein, and the manner of attaining them, will be better understood from the following description in conjunction with the accompanying drawing figures, in which like reference numerals identify like elements, and wherein.

DETAILED DESCRIPTION

In the following detailed description of embodiments of the present disclosure, reference is made to the accompanying drawings that form a part hereof, and in which is shown by way of illustration, and not by way of limitation, such specific embodiments. It is to be understood that other embodiments may be utilized and that changes may be made without departing from the spirit and scope of the present disclosure.

Figure 1:
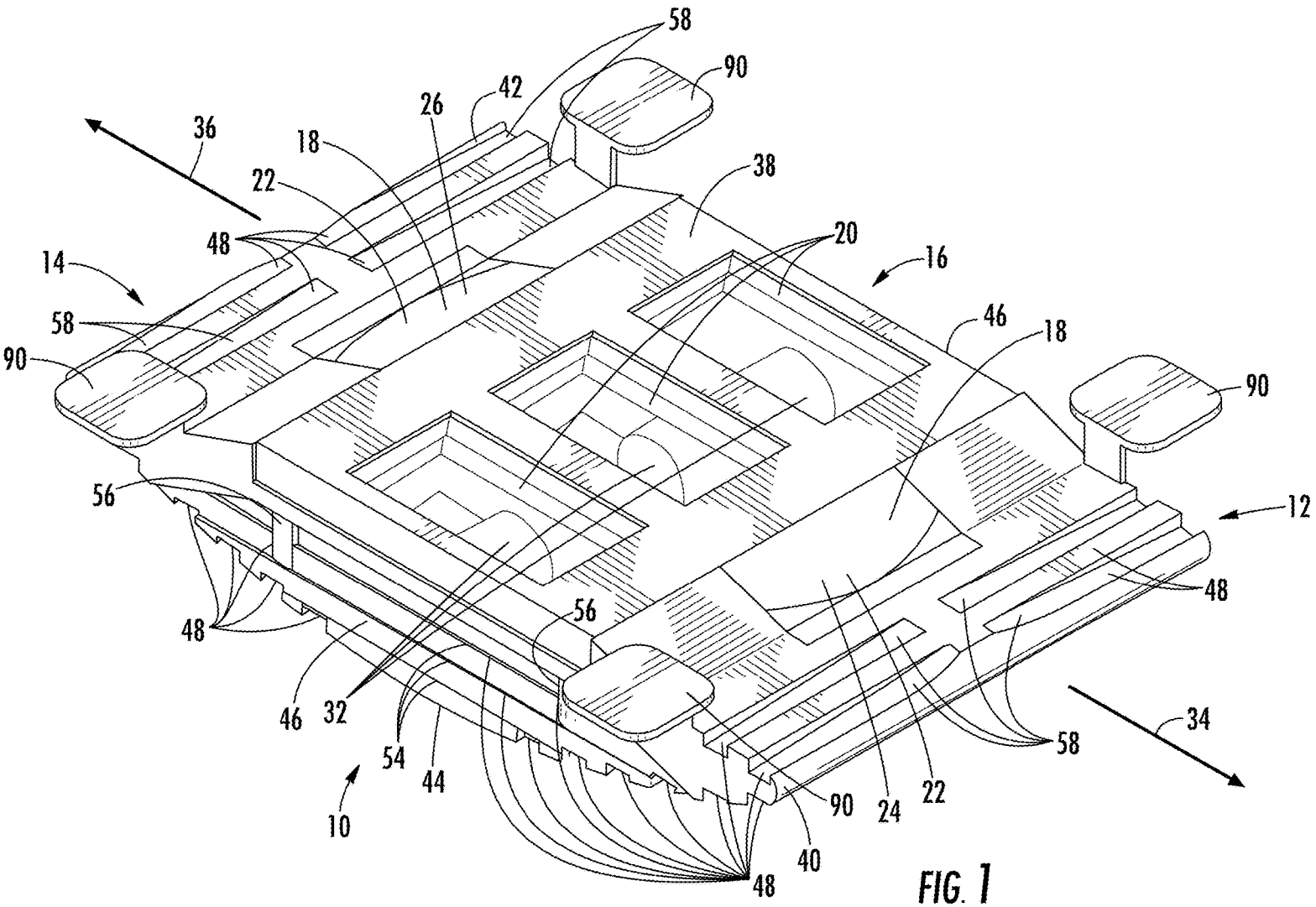
FIG. 1 is a perspective view of an upper side of a roadway marker in accordance with an embodiment of the present disclosure.

Referring now to FIG. 1, a road marker 10 is provided. The road marker 10 includes a housing 38 having a first end portion 12, a second end portion 14, and a central portion 16. The housing 38 is made from a high impact polycarbonate material in the illustrated embodiment, but may be made from any durable material. The road marker 10 further includes a light source 18 disposed at the first end portion 12 and/or the second end portion 14 and a solar energy collection member 20 disposed at the central portion 16.

Figure 2:
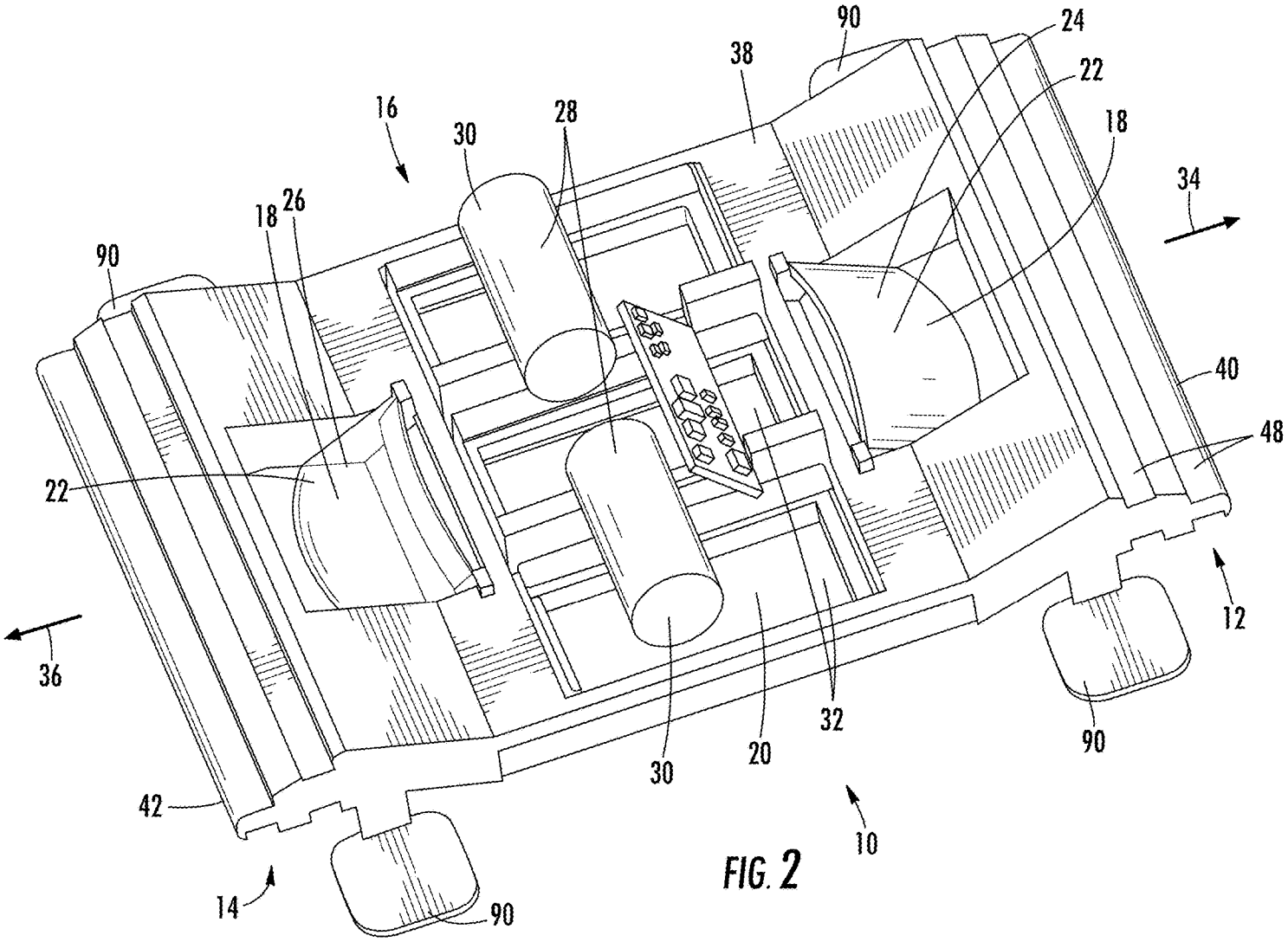
FIG. 2 is a perspective view of a lower side of a roadway marker in accordance with an embodiment of the present disclosure.

FIG. 2 illustrates the interior of the housing 38 from a lower perspective with the lower portion of the housing 38 removed. As illustrated in FIG. 2, the light source 18 in the illustrated embodiment includes one or more light-emitting diode (LED) lamps 22. In the illustrated embodiment, the light source 18 of the marker 10 includes a first three LED series 24 disposed at the first end portion 12 and configured to emit light in a first direction 34 away from the central portion 16 and a second three LED series 26 disposed at the second end portion 14 and configured to emit light in a second direction 36 away from the central portion 16. In an embodiment not illustrated, the light source 18, including one or more LED lamps, are oriented toward or away from a lane of a roadway. In the embodiment illustrated, the first direction 34 is opposite from and substantially parallel with the second direction 36. In additional embodiments not illustrated, the light source 18 includes any number of lamps based upon a desired brightness and/or visibility. Further, in additional embodiments not illustrated, the light source 18 may include a light source other than an LED lamp. The light source 18 of the illustrated embodiment is configured to emit light in a direction away from the central portion 16. The light source 18 of the illustrated embodiment includes one or more lenses, including a white, amber, and/or red lens in order to signal motorists or pedestrians or serve another purpose. In additional embodiments, the lens may be any other color or tint, and may include any additional structure or composition to alter light, such as magnification structure, reflecting structure, and/or filtration structure in non-limiting examples. One and/or both of the light sources 18 in the marker 10 has between 100 and 1200 lumens in an embodiment, between 200 and 1000 lumens in another embodiment, and between 300 and 700 lumens in another embodiment. One and/or both of the light sources 18 has less than 100 lumens in an embodiment and greater than 1200 lumens in another embodiment. Such lumen values may be distributed among any number of LED or other lamps or light sources at one or both ends of the marker 10.

As illustrated in FIG. 2, the marker 10 further includes an energy storage member 28 configured to store energy for powering the light source 18. The energy storage member 28 includes two capacitors 30 in the illustrated embodiment. In additional embodiments, the marker 10 includes any number of capacitors 30 based upon the energy storage requirements of the marker 10. In additional embodiments not illustrated, the energy storage member 28 is one or more batteries or other energy storage device. In the illustrated embodiment, the capacitors 30 are oriented end-to-end and aligned substantially perpendicular to the directions 34, 36. In other embodiments, such as the embodiment illustrated in FIGS. 6-10, the capacitors 30 are oriented and/or aligned in different ways.

As further illustrated in FIGS. 1 and 2, the solar energy collection member 20 supplies energy to the energy storage member 28 and includes one or more photovoltaic cells or solar cells 32. In the illustrated embodiment, the marker 10 includes three solar cells 32, but any number of solar cells 32 may be utilized in additional embodiments. In the illustrated embodiment, the solar cells 32 are aligned perpendicular to the directions 34, 36, but may be aligned in either or both of the directions 34, 36 (as shown in the embodiments of FIGS. 6-11), or in any other orientation. In an embodiment having multiple solar cells 32, the solar cells 32 are redundantly provided such that, in the event that one or more solar cells 32 fails, becomes damaged, or its operation is otherwise reduced or terminated, the remaining solar cell(s) 32 may continue to supply energy to the energy storage member 28 and/or the light source 18. The marker 10 of one or more embodiments includes electronic circuitry and/or one or more electronic components described in FIGS. 10-15, and the text referencing FIGS. 10-15, of U.S. Pat. No. 5,839,816 to Varga et al., which portions are incorporated herein by reference.

Referring again to FIGS. 1 and 2, the marker 10 includes a plurality of recesses 48 disposed on the housing 38 and configured to receive adhesive for securing the road marker 10 in a channel 50 of a roadway 52, as described in further detail below. The housing 38 includes at least one first end surface 40, at least one second end surface 42, at least one lower surface 44, and at least one side surface 46. The plurality of recesses 48 is disposed in one or more of the first end surface(s) 40, the second end surface(s) 42, the lower surface(s) 44, and the side surface(s) 46 and is configured to secure the housing 38 in the channel 50. The plurality of recesses 48 includes at least one horizontally extending recess 54 in an embodiment. The plurality of recesses 48 includes at least one vertically extending recess 56 in an embodiment. The plurality of recesses 48 includes one or more recesses 58 tapered from the first end surface(s) 40, the second end surface(s) 42, the side surface(s) 46, and/or the lower surface(s) 44 into the housing 38.

Figure 3:
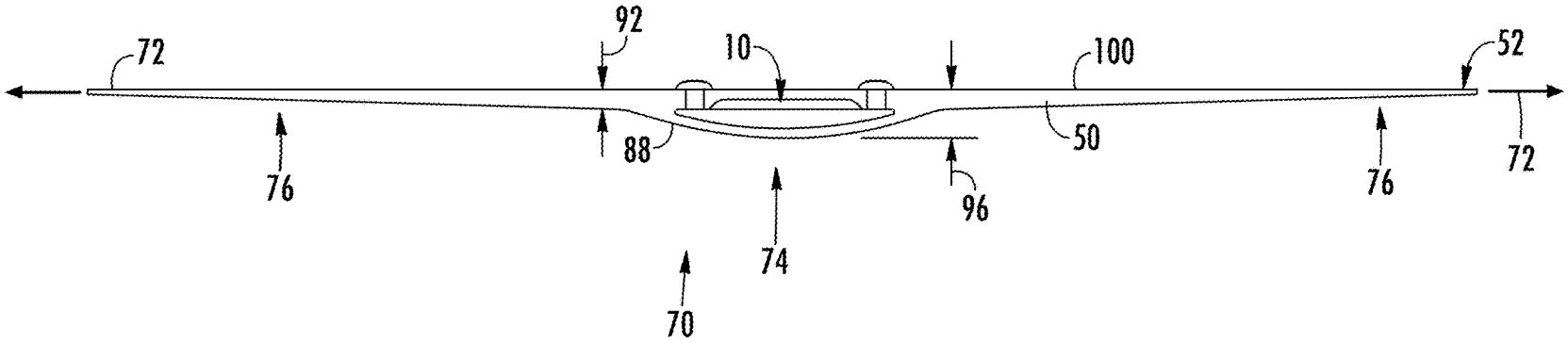
FIG. 3 is an elevation view of a roadway marker installation in accordance with an embodiment of the present disclosure.
Figure 4:
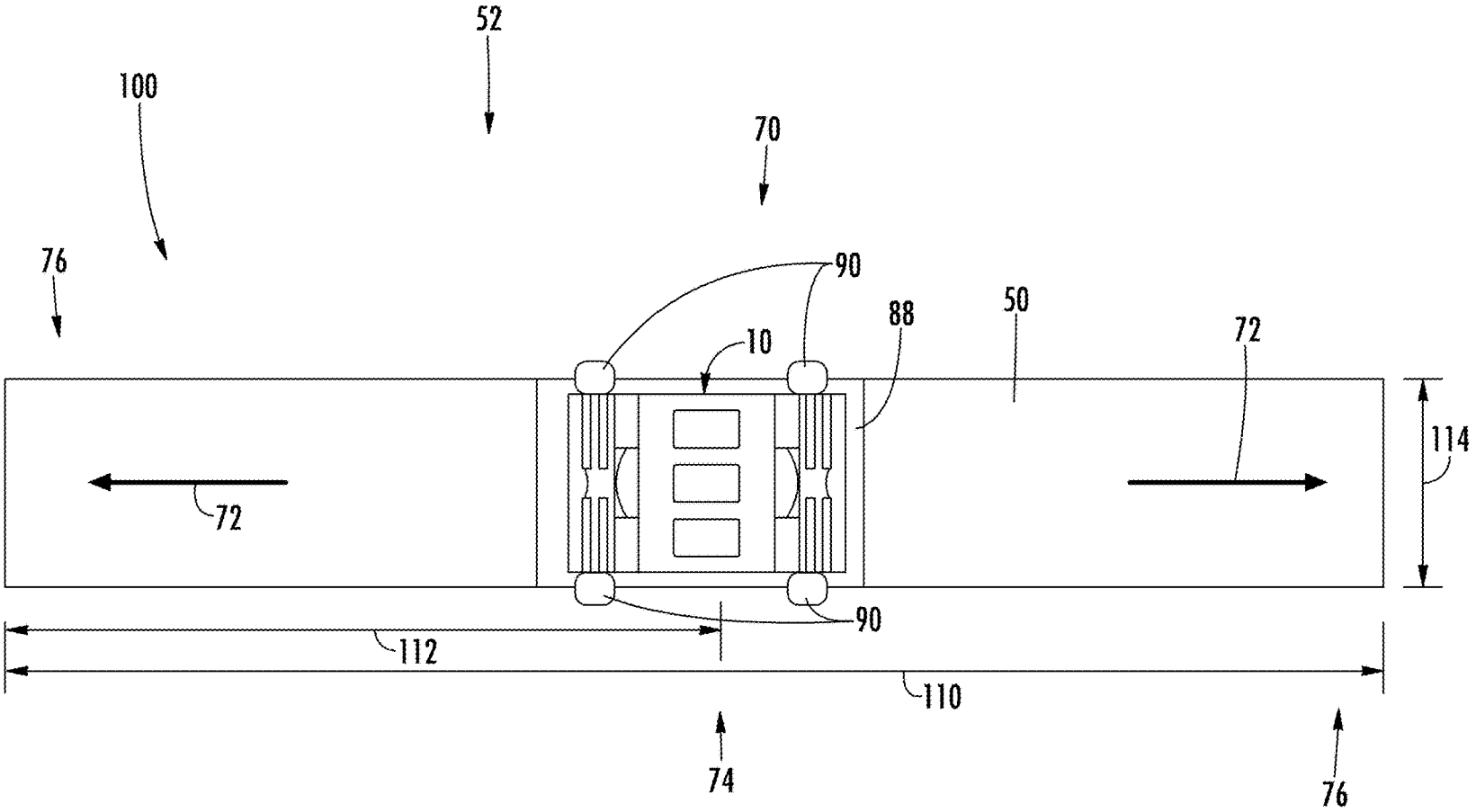
FIG. 4 is a top plan view of a roadway marker installation in accordance with an embodiment of the present disclosure.
Figure 5:
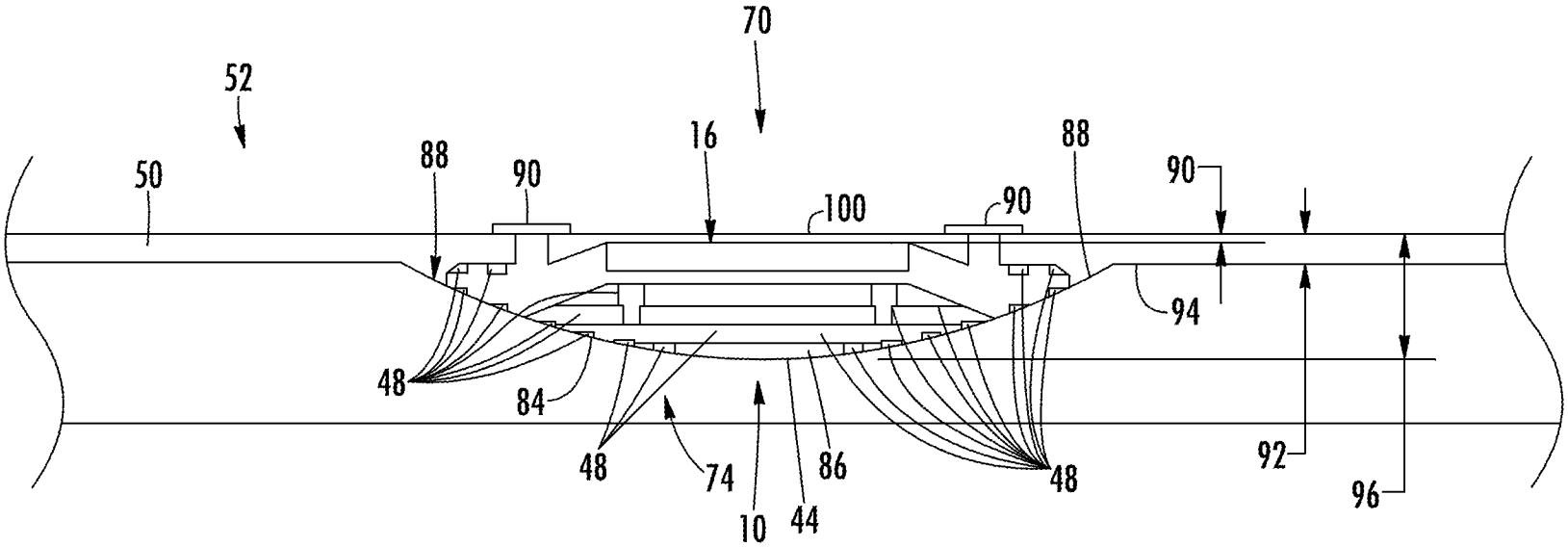
FIG. 5 is an enlarged elevation view of a roadway marker installation in accordance with an embodiment of the present disclosure.
Figure 6:
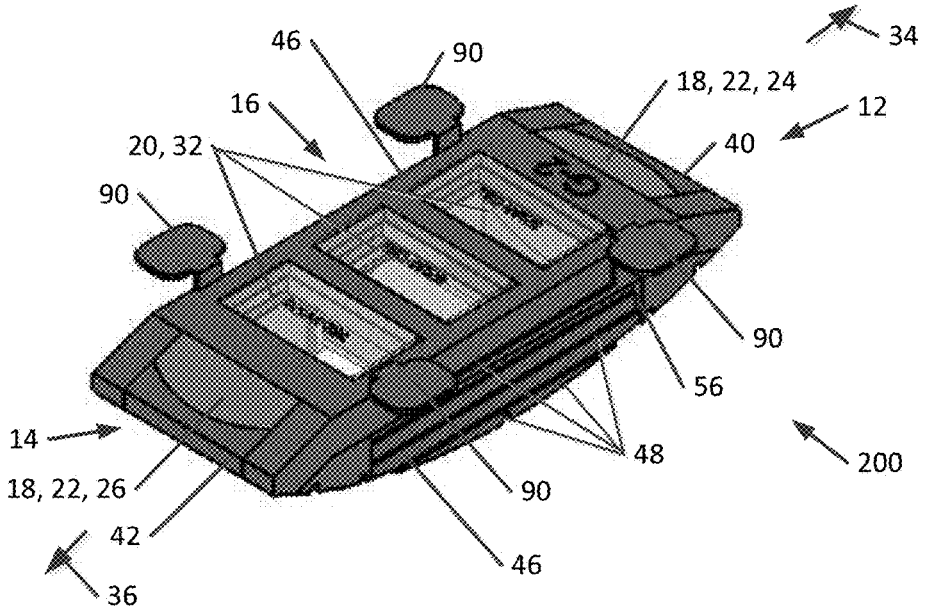
FIG. 6 is perspective view of an upper side of a roadway marker in accordance with an embodiment of the present disclosure.

Referring now to FIGS. 3-5, an installation 70 for the roadway 52 is illustrated having an embodiment of the marker 10 as described herein. The roadway 52 extends along a longitudinal axis 72 and has a roadway upper surface 100. The installation 70 includes the channel 50 formed in the roadway 52 and extending along the longitudinal axis 72. The channel 50 includes a marker portion 74 and one or more channel end(s) 76 tapered from the marker portion 74 to the roadway upper surface 100. In the illustrated embodiment, there are two channel ends 76 disposed on opposite sides of the marker portion 74 of the channel 50. In an embodiment not illustrated, the channel 50 includes only one channel end 76. The channel 50 of the illustrated embodiment includes an overall channel length 110 with a marker distance 112 defined as approximately half the value of the overall channel length 110. The overall channel length 110 is between 12 inches and 240 inches in an embodiment, between 24 inches and 120 inches in another embodiment, and approximately 84 inches in another embodiment. The overall channel length 110 is less than 12 inches in an embodiment and greater than 240 inches in an embodiment. Additionally, in one or more embodiments not illustrated, the channel 50 is not tapered at one or both channel ends 76 such that the channel 50 has substantially the same depth between the channel ends 76, or may include any combination or variation of a tapered or non-tapered channel 50. In one or more embodiments, the light source 18 is aligned with, focused on, and/or pointed toward the channel end 76.

The installation 70 further includes the road marker 10 in accordance with any embodiment described herein disposed at least partially in the marker portion 74 of the channel 50. The road marker 10 includes the housing 38, embodiments of which are best illustrated in FIGS. 1 and 2, to contain an energy source, such as the solar energy collection member 20 and/or the energy storage member 28, and the light source 18 powered by the energy source and configured to emit light along the longitudinal axis 72. As illustrated in FIG. 4, the marker 10 is sized to fit within a channel width 114. The channel width 114 is between 2 inches and 24 inches in an embodiment, between 4 inches and 12 inches in another embodiment, and approximately 6 inches in another embodiment. The channel width 114 is less than 2 inches in an embodiment and greater than 24 inches in another embodiment. In one or more embodiments, the marker 10 has a width between 0.2 inch and 6 inches less than the channel width 114 in an embodiment, between 1 inch and 3 inches less than the channel width 114 in another embodiment, less than 0.2 inch less than the channel width 114 in another embodiment, and greater than 6 inches less than the channel width 114 in another embodiment.

As best illustrated in FIG. 5, the housing 38 of the road marker 10 includes a first end portion height 78 of the first end portion 12 and a second end portion height 80 of the second end portion 14. The central portion 16 includes a central portion height 82 greater than the first end portion height 78 and/or the second end portion height 80. The central portion height 82 relative to the first end portion height 78 and/or the second end portion height 80 provides strength to the overall marker structure, reducing the likelihood of damage or failure of the housing 38 upon impact with a vehicle wheel or another object. Further, as illustrated in FIGS. 3-5, the central portion 16 is positioned in the channel 50 and configured to be disposed below the roadway upper surface 100. In the illustrated embodiment, the solar energy collection member 20 is positioned and/or configured to be positioned below the roadway upper surface 100.

In additional embodiments not illustrated, the central portion 16 and/or another portion of the marker 10 is disposed above the surface 100. Further, in additional embodiments not illustrated, the marker 10 is positioned on the surface 100 without being disposed in the channel 50. The light source 18 is substantially aligned with the longitudinal axis 72 in an embodiment and/or configured to emit light toward the channel end(s) 76.

A method of forming the installation 70 in accordance with one or more embodiments includes forming the channel 50 in the roadway 52. Forming the channel 50 includes forming the marker portion 74 and the channel end(s) 76 in the roadway 52. The marker portion 74 is formed by removing roadway material with a tool (not illustrated) to form a radius 84. For example, the tool may include a radius between 10 inches and 22 inches to form the radius 84, but may include a radius less than 10 inches in an embodiment, and may include a radius greater than 22 inches in an embodiment. In additional embodiments, the tool includes any radius to form the marker portion 74 and/or another portion of the channel 50. In an embodiment, the radius 84 is substantially equal to a radius 86 of the lower surface 44 of the marker 10, as best illustrated in FIG. 5. As illustrated in FIGS. 4 and 5, the plurality of recesses 48 are configured to receive adhesive 88 for securing the road marker 10 in the channel 50 of the roadway 52. The adhesive 88 in an embodiment is epoxy, but the adhesive 88 may include any one or more materials known by those having ordinary skill in the art. The recesses 48 provide increased surface area and edges for interaction with the adhesive 88 to allow the marker 10 to stay reliably fixed in or on the roadway 52, thereby reducing the likelihood of dislodgement of the marker 10 from the roadway 52 to result in loss of its marking function and/or damage to individuals and property caused by the marker 10 being forcefully ejected from the roadway 52.

Referring to FIG. 5, the installation 70 is arranged such that a road surface clearance 90 is defined between the central portion 16 and the roadway upper surface 100. The road surface clearance 90 is between 0 and 0.5 inches in an embodiment, between 0.0625 inch and 0.25 inch in another embodiment, and approximately 0.12 inch in another embodiment. The installation 70 is also arranged in an embodiment such that a channel end depth 92 is defined between a lower channel end surface 94 near the marker portion 74 and the roadway upper surface 100. The channel end depth 92 is between 0 and 1 inch in an embodiment, between 0.25 inch and 0.5 inch in another embodiment, and approximately 0.4 inch in an embodiment. The installation 70 is arranged such that a marker portion depth 96 is defined between a lower marker portion surface 98 and the roadway upper surface 100. The marker portion depth 96 is between 0.5 inch and 3 inches in an embodiment, between 1.0 inch and 2 inches in another embodiment, and approximately 1.5 inches in another embodiment. The marker portion depth 96 is less than 0.5 inch in an embodiment and greater than 3 inches in another embodiment.

The method of an embodiment includes positioning the marker 10 at the marker portion 74 of the channel 50. The marker 10 of one or more embodiments includes one or more tab(s) 90 configured to be positioned on the roadway upper surface 100. The method includes positioning the tab(s) 90 on the roadway upper surface 100 such that the remaining portions of the marker 10 are disposed in the channel 50. In an embodiment, the tab(s) 90 may be removed such that the entire marker 10 is disposed below the roadway upper surface 100.

The marker 10 and/or the installation 70 provides visibility for a roadway or any other surface while being sufficiently durable to handle impact from vehicles, including snow plows and other heavy equipment, and exposure to extreme temperature, precipitation, and other conditions. In the illustrated embodiments, the marker 10 and/or the installation 70 is visible from a distance of at least 300 feet from the marker 10. The marker 10 and/or the installation 70 is visible from a distance of at least 500 feet in another embodiment, from a distance of at least 1000 feet in another embodiment, and from a distance of at least 1200 feet in another embodiment.

The marker 10 was compared to a conventional marker, specifically the Model 201 recessed pavement markers having a C-40 lens commercially available from Ennis-Flint of Thomasville, N.C. 27360, for visibility along a roadway during the early morning hours of two separate days. The conventional marker and the marker 10 of the illustrated embodiment of the present disclosure were each evaluated based on a maximum distance from the marker that light from the marker was visible.

| | Conventional Marker | Marker 10 |
|---|---|---|
| Day 1 | 400 feet | 1000 feet |
| Day 2 | 550 feet | 1200 feet |

As illustrated above, the marker 10 provides visibility significantly greater than conventional roadway markers. Light from the conventional marker was visible no more than approximately 400 feet from the marker on day 1 and no more than approximately 550 feet on day 2. In contrast, light from the marker 10 was visible approximately 1000 feet from the marker on day 1 and approximately 1200 feet from the marker on day 2. It will be appreciated that one or more embodiments of the installation 70, as described herein, will provide the same visibility as the marker 10 of any embodiment described herein, as the marker 10 according to any embodiment described herein is incorporated into the installation 70 of any embodiment described herein. Such visibility significantly improves the safety and saves the lives of motorists and pedestrians on and along roadways, especially during rain, fog, snow, and nighttime conditions. The marker 10 and installation 70 is also structured to be more durable and reliably fixed to or in the roadway 52 compared to conventional road markers. Further, as a result of the self-powered and self-contained nature of the marker 10 and/or the installation 70, the marker 10 and/or the installation 70 is easily installed, maintained, and operated.

Figure 7:
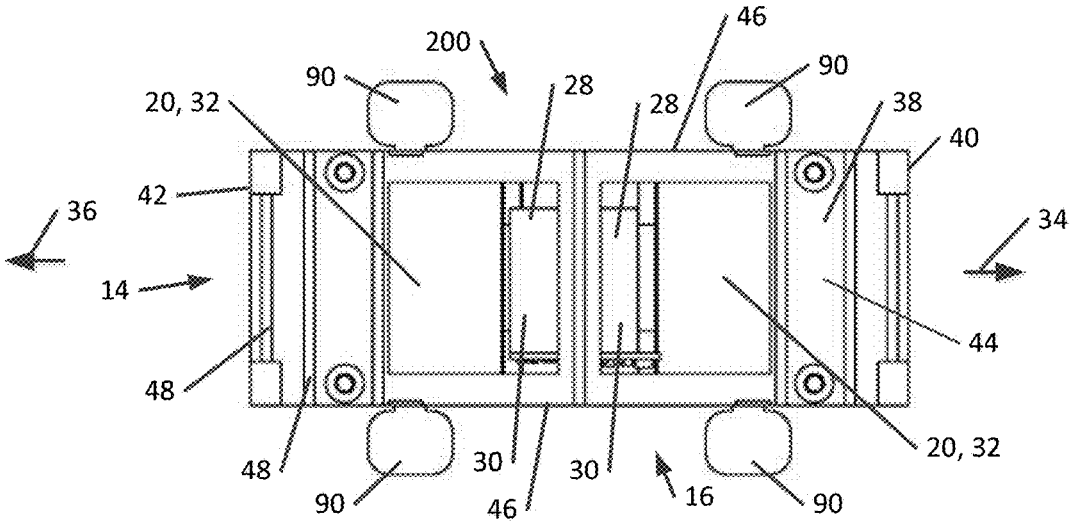
FIG. 7 is a bottom view of a roadway marker in accordance with an embodiment of the present disclosure.
Figure 8:
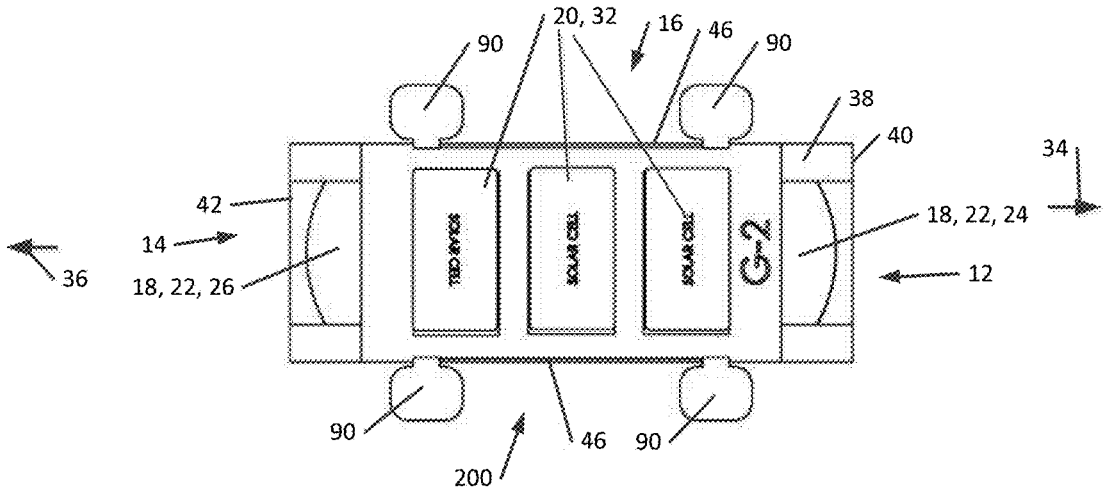
FIG. 8 is a top view of a roadway marker in accordance with an embodiment of the present disclosure.
Figure 9:
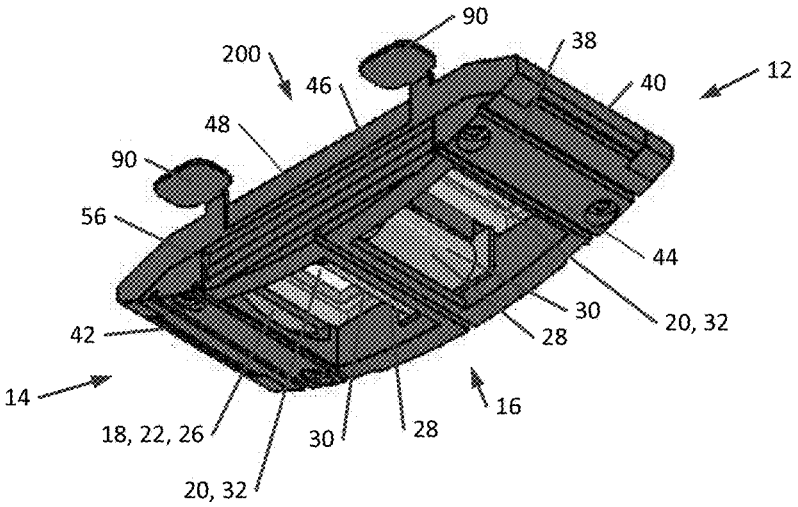
FIG. 9 is a perspective view of a bottom side of a roadway marker in accordance with an embodiment of the present disclosure.
Figure 10:
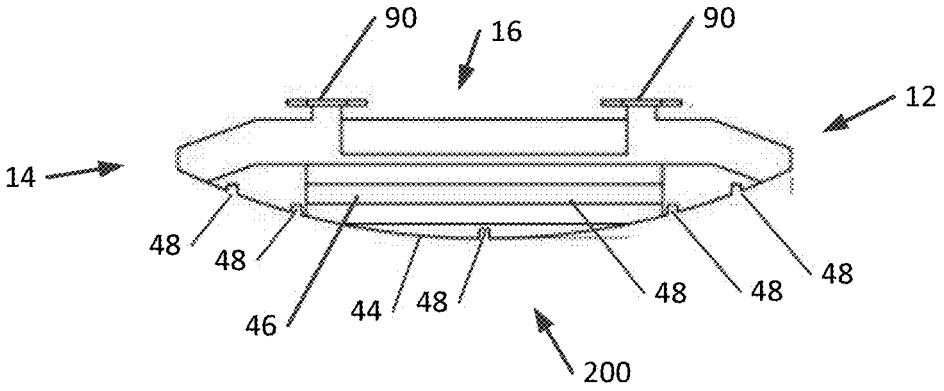
FIG. 10 is a first side view of a roadway marker in accordance with an embodiment of the present disclosure.
Figure 11:
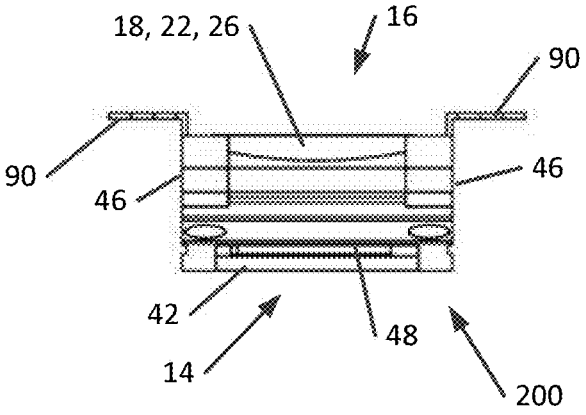
FIG. 11 is a second side view of a roadway marker in accordance with an embodiment of the present disclosure.

FIGS. 6-11 illustrate another road marker 200 in accordance with the teachings of this disclosure. The road marker 200 and/or structures, elements, components, and/or features of the road marker 200 perform similar or identical functions to the road marker 10 and/or structures, elements, components, and/or features of the road marker 10. Therefore, structures, elements, components, and/or features of the road marker 200 of FIGS. 6-11 that are similar or identical to the structures, elements, components, and/or features of the road marker 10 of FIGS. 1-5 are labeled with like figure numbers. In the embodiment of FIGS. 6-11, the solar cells 32 are aligned in the directions 34, 36. Moreover, as shown in FIG. 7, the capacitors 30 are oriented side-to-side and aligned in the directions 34, 36 to enable a width of the road marker 10 to be less than twice a length of one of the capacitors 30.

The housing 38 of FIGS. 6-11 has a width. The width is a distance from one of the side surfaces 46 to the other one of the side surfaces 46 of the housing 38. In some embodiments, the width is approximately three inches or less. For example, the width may be approximately two inches to approximately three inches. In some embodiments, the width is approximately 2.5 inches to approximately three inches. In some embodiments, the width is approximately 2.75 inches to approximately three inches. However, the above-noted values are merely an examples and, thus, other embodiments may have widths of other values.

As a result, the road marker 200 disclosed herein is less likely to be broken, loosened, and/or dislodged from the channel by vehicles during use than traditional road markers. Furthermore, even if not broken, loosened, and/or dislodged from the channel 50 by contact with a vehicle tire moving across the channel 50 in which the road marker 200 is disposed, contact between the tire dipping into the channel 50 and the light source(s) 18 and/or the solar energy collection members 20 mars the light source(s) 18 and/or the solar energy collection members 20 significantly, thus reducing or eliminating the properties of the light source(s) 18 and/or the solar energy collection members 20. By having a width of approximately three inches or less for the channel 50, there is insufficient room for a vehicle tire to dip into the channel 50 as it passes over, thereby preventing marring of the light source(s) 18 and/or the solar energy collection members 20. Thus, the road markers 200 disclosed herein have longer useful lives than traditional road markers.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

I claim:

1. A road marker for positioning at least partially below a surface of a roadway, the road marker comprising:

a housing having:

a first end portion;

a second end portion;

a central portion disposed between the first end portion and the second end portion; and a tab configured to be positioned on the roadway surface, wherein the tab is positioned above the first end portion, the second end portion, and the central portion such that when the tab is positioned on the roadway surface, the first end portion, the second end portion, and the central portion are positioned below the roadway surface, and wherein the central portion is positioned higher than at least one of the first end portion and the second portion;

a light source disposed at the first end portion, wherein the light source is configured to emit light in a direction away from the central portion; and a solar energy collection member disposed on the housing and configured to be positioned below the roadway surface.

2. The road marker of claim 1, wherein the light source is a first light source disposed at the first end portion and configured to emit light in a first direction away from the central portion; and wherein the road marker further comprises:

a second light source disposed at the second end portion and configured to emit light in a second direction away from the central portion.

3. The road marker of claim 1, further comprising an energy storage member configured to store energy to power the light source.

4. The road marker of claim 3, wherein the solar energy collection member is to supply energy to the energy storage member.

5. The road marker of claim 1, further comprising a plurality of recesses disposed in the housing and configured to receive adhesive to secure the road marker in a channel of the roadway.

6. The road marker of claim 5, wherein the plurality of recesses include a horizontally extending recess.

7. The road marker of claim 5, wherein the housing includes a first end surface, a second end surface, a lower surface, and a side surface, the recesses being disposed in the first end surface, the second end surface, the lower surface, and the side surface.

8. The road marker of claim 7, wherein the recesses includes a recess tapered from at least one of the first end surface, the second end surface, the lower surface, and the side surface into the housing.

9. A road marker comprising:

a housing, comprising:

a first end portion;

a second end portion;

a first end surface and a second end surface disposed on a first side of the housing; and a lower surface disposed on a second side of the housing, the second side being opposite to the first side;

a light source disposed at the first end portion; and a plurality of recesses disposed in the first end surface, the second end surface, and the lower surface and configured to secure the housing in a road recess.

10. The road marker of claim 9, wherein the plurality of recesses includes a horizontally extending recess.

11. The road marker of claim 9, wherein the housing further includes a side surface, the plurality of recesses being disposed in the first end surface, the second end surface, the lower surface, and the side surface.

12. The road marker of claim 11, wherein the plurality of recesses includes a horizontally extending recess.

13. The road marker of claim 9, wherein the plurality of recesses includes a recess tapered into the housing from at least one of the first end surface, the second end surface, and the lower surface.

14. An installation for a roadway, the roadway extending along a longitudinal axis and having a roadway upper surface, the installation comprising:

a channel formed in the roadway and extending in a longitudinal direction, the channel including a marker portion and a channel end tapered from the marker portion to the roadway upper surface; and a road marker disposed at least partially in the marker portion of the channel, the road marker comprising:

a housing comprising a first end portion, a second end portion, and a central portion disposed between the first and second end portions;

an energy source operatively coupled to the housing;

a light source operatively coupled to the first end portion of the housing, the light source to be powered by the energy source and configured to emit light along the longitudinal axis in a direction away from the central portion; and wherein the housing, the energy source and the light source are positioned below the roadway upper surface; and wherein the housing has a central portion height that is greater than a height of at least one of the first end portion and the second portion.

15. The installation of claim 14, wherein the light source is substantially aligned with the longitudinal axis and configured to emit light toward the channel end.

* * * * *